US008714305B2

(12) United States Patent
Fontaine

(10) Patent No.: US 8,714,305 B2
(45) Date of Patent: May 6, 2014

(54) QUICK CONNECT ROOF CLIP AND ROOF JACK

(75) Inventor: Scott Fontaine, Seattle, WA (US)

(73) Assignee: Roofing Technologies, LLC, Seattle, WA (US)

( * ) Notice: Subject to any disclaimer, the term of this patent is extended or adjusted under 35 U.S.C. 154(b) by 146 days.

(21) Appl. No.: 12/948,742

(22) Filed: Nov. 17, 2010

(65) Prior Publication Data

US 2012/0118667 A1 May 17, 2012

(51) Int. Cl.
*E04G 3/26* (2006.01)

(52) U.S. Cl.
USPC ..... 182/45

(58) Field of Classification Search
USPC ..... 182/45; 248/237
See application file for complete search history.

(56) References Cited

U.S. PATENT DOCUMENTS

| | | | | | |
|---|---|---|---|---|---|
| 1,006,562 | A | * | 10/1911 | Kefover | 248/237 |
| 1,241,335 | A | | 9/1917 | Boyd | |
| 1,691,478 | A | * | 11/1928 | Henderson | 248/237 |
| 1,886,921 | A | | 11/1932 | Tobin | |
| 4,856,745 | A | | 8/1989 | Mabie | |
| 5,829,203 | A | * | 11/1998 | Ealer, Sr. | 52/37 |
| 5,975,239 | A | | 11/1999 | Castaneda | |
| 2008/0302934 | A1 | * | 12/2008 | Nelson et al. | 248/237 |

* cited by examiner

*Primary Examiner* — Katherine Mitchell
*Assistant Examiner* — Kristine Florio
(74) *Attorney, Agent, or Firm* — Martin Garthwaite; Æ ON Law; Adam L. K. Philipp

(57) ABSTRACT

A quick connect roof clip is releasably attachable to at least one quick connect roof jack. The quick connect roof clip is releasable from the quick connect roof jack and may be left in place for later use. A structure or element is provided for attachment of a lanyard attachment. The quick connect roof clip and quick connect roof jack may be releasably connected by a quick connect attachment head.

9 Claims, 7 Drawing Sheets

Figure 1, prior art

QUICK CONNECT ROOF CLIP AND ROOF JACK

SUMMARY OF THE INVENTION WITH BACKGROUND INFORMATION

This summary is provided to introduce a selection of concepts in a simplified form that are further described below in the detailed description. This summary is not intended to identify key or essential features of the claimed subject matter, nor is it intended to be used to limit the scope of the claimed subject matter.

Generally stated, roof jacks are used on pitched roofs to provide a temporary relatively horizontal platform for standing, placing equipment and supplies, and similar. A prior art roof jack is shown in FIG. 1, showing part of FIG. 2 of the drawing figures for U.S. Pat. No. 6,715,254. In a typical use case, two or more roof jacks are attached to a pitched roof at substantially the same vertical height; the roof jacks have a horizontal member (relative to the ground), 002 in FIG. 1. A plank is placed between the two horizontal members, forming the generally horizontal platform mentioned above.

The method of attachment for roof jacks in the prior art is to drive a nail or screw into a rafter (or other suitable underlying structure) through one of the grooves in the roof jack provided for this purpose, such as the groove at 001. It is common to place shingles over the top portion of the temporarily installed roof jack (approximately from horizontal member 002, upward), covering the nail or screw. It is also common to temporarily install roof jacks beneath existing shingles, which requires bending back the existing shingles and awkward pounding in of the nail. To remove an installed prior art roof jack, the bottom of the roof jack, 003, is hit upward with a hammer, pushing the roof jack up, along the path defined by the groove 001. Once the nail is free of the groove, then the roof jack may be removed and the nail hammered in. The resulting nail and nail hole compromises the water-sealing integrity of the roof. In addition, it is common for the installation and removal of roof jacks, with bending-back of shingles, hammering of the roof jacks, forceful hammering in (and potential extraction) of nails, and the like to damage shingles, puncture roof membranes, and de-laminate roof components (including shingles, membranes, etc.). In addition, prior art roof jacks are not designed to act as securement points for safety harnesses or lanyards (referred to herein as "lanyards"). When work later needs to be performed on the roof, roof jacks and/or eye-hooks will need to be (re)installed in order to provide a horizontal surface or to provide attachment points for lanyards.

The art has not demonstrated a satisfactory attachment device for a roof jack, which attachment device reduces or eliminates damage to roof components, to which lanyards may be attached, which allows the roof jack to be removed, and which may be permanently affixed to the roof for future use.

Generally stated, the disclosed invention is directed to a roof jack and/or associated attachment device which reduces or eliminates damage to roof components, to which lanyards may be attached, which allows the roof jack to be removed, and which may be permanently affixed to the roof for future use.

DETAILED DESCRIPTION

The following detailed description refers to the accompanying drawings.

The following detailed description is for the purpose of illustrating embodiments of the invention only, and other embodiments are possible without deviating from the spirit and scope of the invention, which is limited only by the appended claims. The figures and elements discussed in this specification use terms meant as examples and not as limitations. Functions equivalent to those illustrated in the figures may be provided by other device(s) or structure(s).

Figure 1:
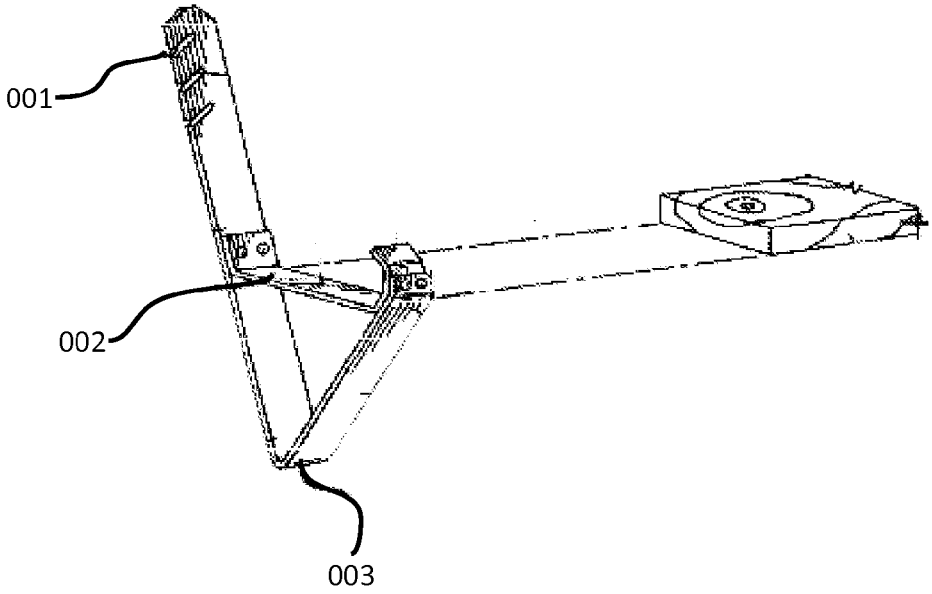
FIG. 1 is a perspective view of a prior art roof jack.

FIG. 1 is a perspective view of a prior art roof jack, discussed above.

Figure 2:
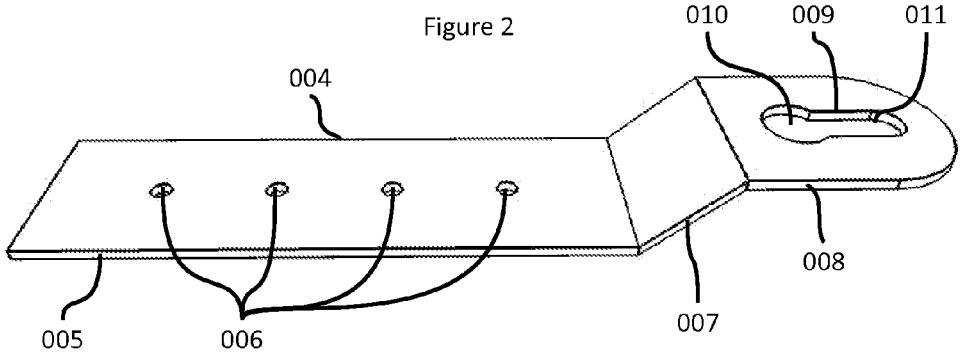
FIG. 2 is a perspective view of a quick connect roof clip

FIG. 2 is a perspective view of a quick connect roof clip 004. The quick connect roof clip 004 comprises a first portion 005 with at least one hole or perforation 006, a connecting portion 007, and a second portion 008.

The second portion 008 comprises an opening 009. In an alternative embodiment, the second portion 008 may comprise a projection suitable for releasable attachment to a corresponding opening. In an alternative embodiment, the second portion 008 may comprise both a projection and an opening, each of which are suitable for releasable attachment to a corresponding opening/projection. In an alternative embodiment, the second portion 008 may be a projection received by a corresponding opening. All such cases may be referred to in the claims as "a connector" and shall be understood to be equivalent to "a connector."

In the clip shown in FIG. 2, the perforations 006 are sized approximately to accommodate 16d framing nails and the connection portion 007 is at a 45° angle to both the first 005 and second portions 008. As used throughout the specification and claims, a clip (or any term including "clip") shall be understood not to include a nail or screw. The angle of the connection portion 007, as shown, is suited to shedding debris when/if the connection portion 007 is left attached to the roof. In an alternative embodiment, the connecting portion 007 may be at a 90° angle or another angle. In an alternative embodiment, the connecting portion 007 may be omitted. As shown, the second portion 008 is parallel to the first portion 005. In an alternative embodiment, the second portion 008 may have a different angle relative to the first portion 005. In an alternative embodiment, the connecting portion 007 may be omitted and the second portion 008 may have a 45° angle relative to the first portion 005.

As shown in FIG. 2, the opening 009 comprises a wider portion 010 and a narrower portion 011 which together form a gravity-locking clip when engaged with a corresponding projection. In other embodiments (not shown), the opening 009 may form any of a range of shapes to accommodate corresponding projections. In other embodiments (not shown), the opening 009 may form a clip other than a gravity-locking clip, such as a clip with a non-gravity dependent mechanical locking mechanism. All such cases may be referred to in the claims as "a connector" and shall be understood to be equivalent to "a connector."

Figure 7:
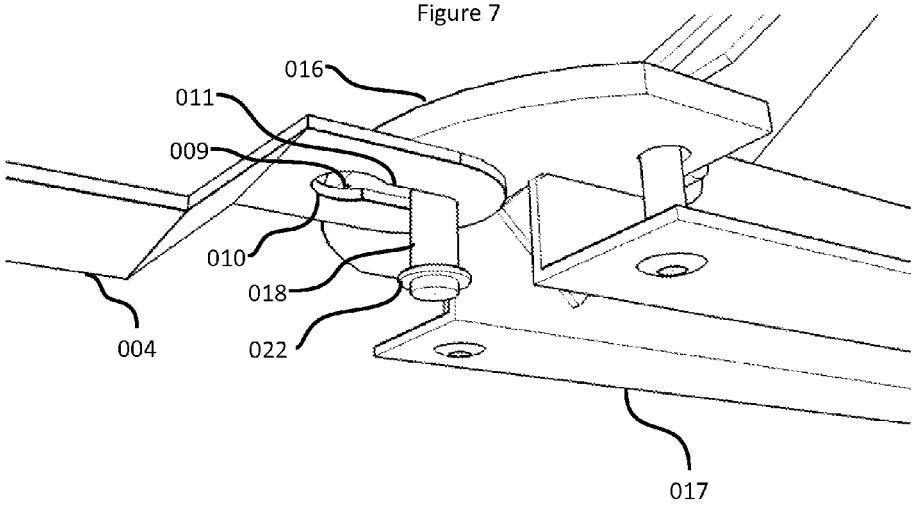
FIG. 7 is a perspective view from below of a quick connect roof clip, a quick connect attachment head, and a quick connect roof jack.
Figure 8:
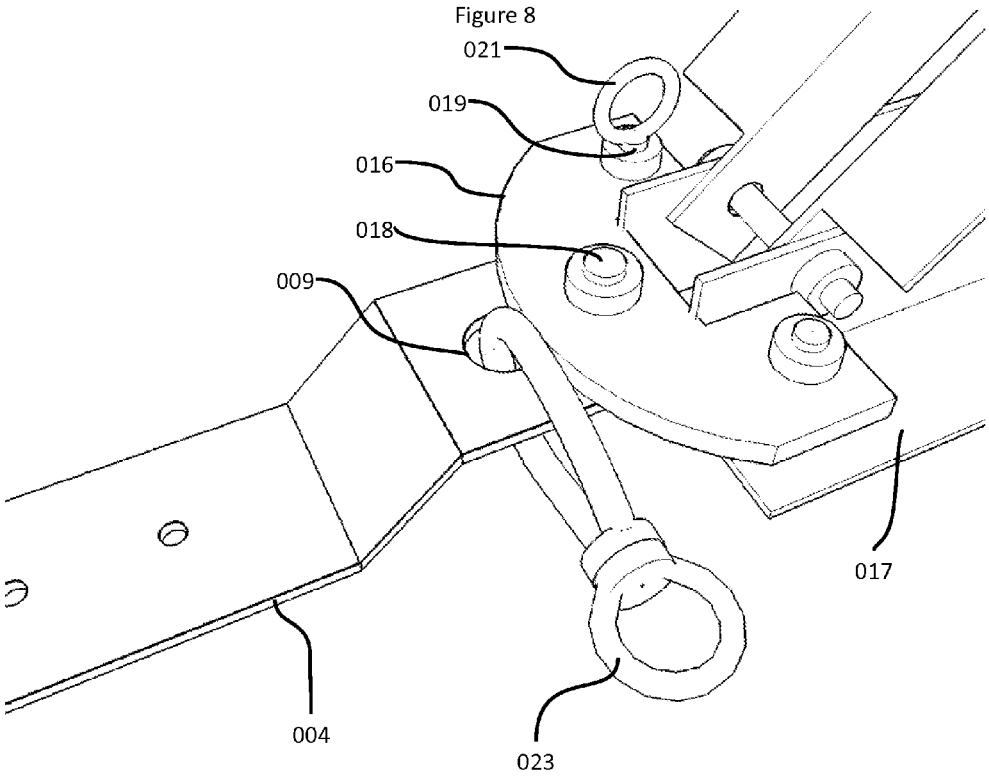
FIG. 8 is a perspective view from above of a quick connect roof clip, a lanyard attachment, a quick connect attachment head, and a quick connect roof jack.

As shown in FIG. 2, the opening 009 is sized to accommodate both a corresponding projection from a roof jack (see FIGS. 6 and 7) and a lanyard attachment (see FIG. 8).

Figure 3:
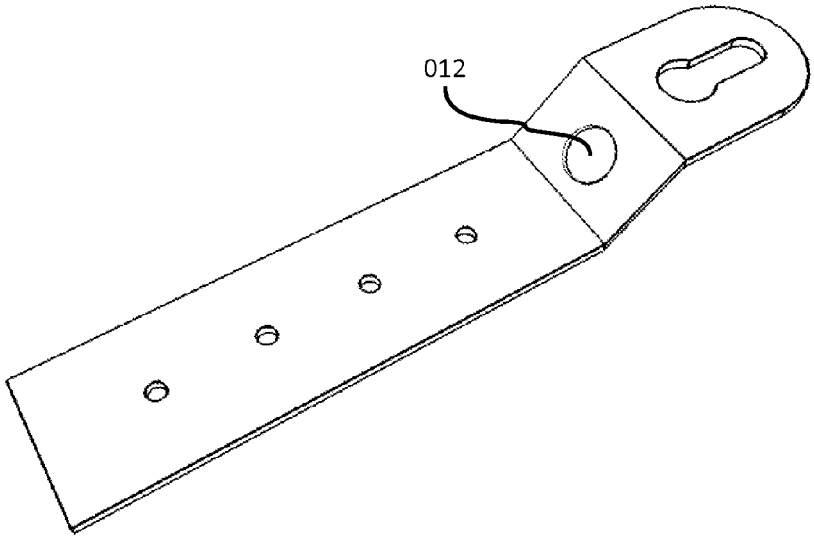
FIG. 3 is a perspective view of a quick connect roof clip.

FIG. 3 is a perspective view of a quick connect roof clip comprising a second opening 012. As shown, the second opening 012 may act as an alternative attachment point for a lanyard attachment or another device or attachment.

Figure 4:
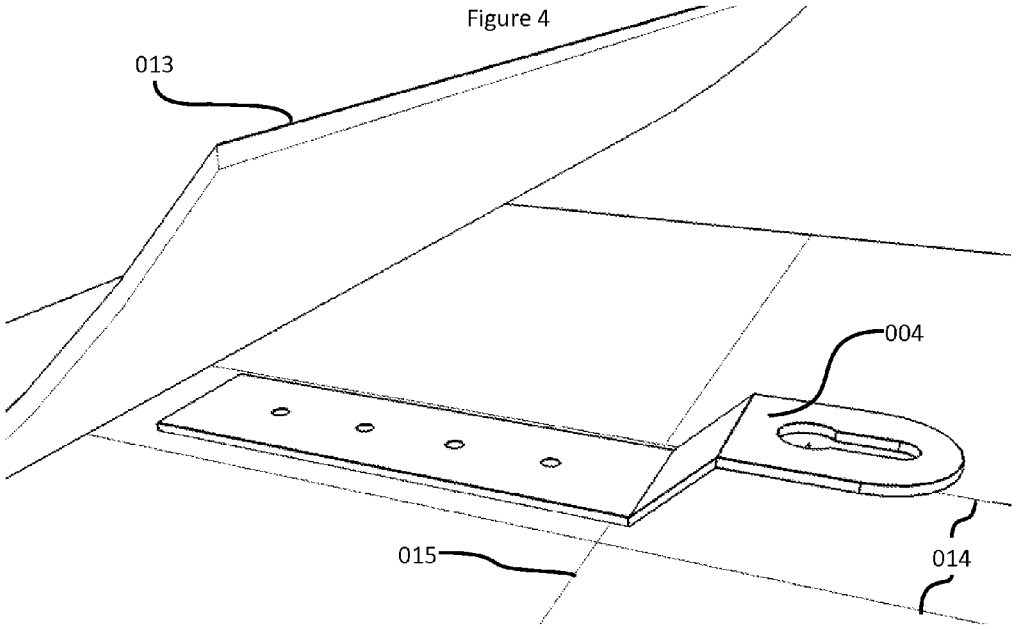
FIG. 4 is a perspective view of a quick connect roof clip, showing features of a roof.
Figure 5:
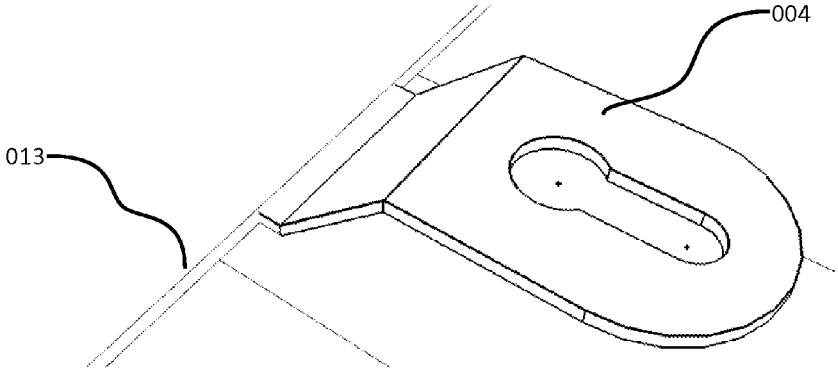
FIG. 5 is a perspective view of a quick connect roof clip, showing features of a roof.

FIG. 4 is a perspective view of a quick connect roof clip 004, showing features of a roof, including a shingle 013, lines 014 where a rafter may lay beneath the quick connect roof clip (to which the quick connect roof clip may be nailed), and a line 015 showing where the shingle lays when down on the roof, as shown in FIG. 5. As used herein, a rafter shall be considered part of a roof.

Figure 6:
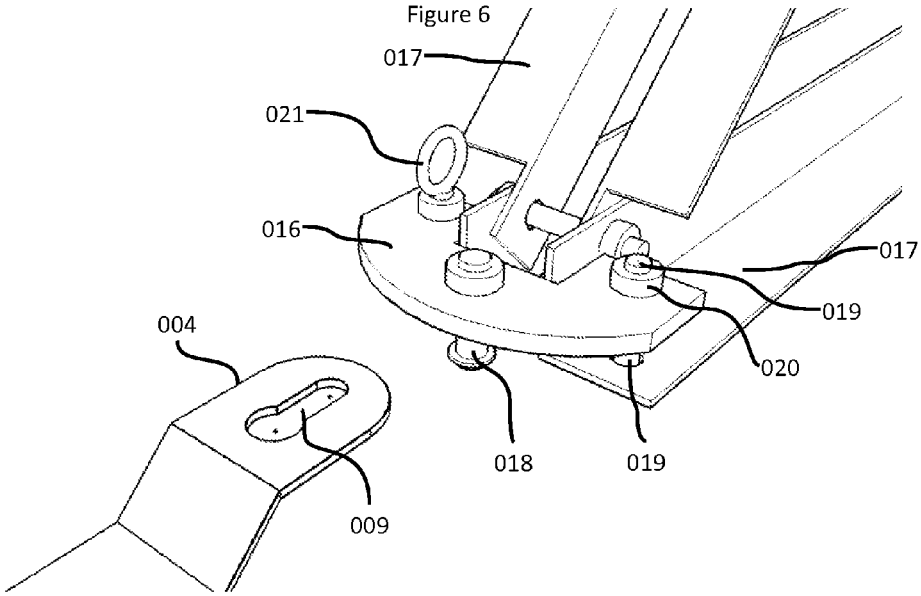
FIG. 6 is a perspective view from above of a quick connect roof clip, a quick connect attachment head, and a quick connect roof jack.

FIG. 6 is a perspective view from above of a quick connect roof clip 004, a quick connect attachment head 016, and a quick connect roof jack 017. The quick connect attachment head 016 is shown as being a separate component from the quick connect roof jack 017; in an alternative embodiment, the functions provided by the quick connect attachment head 016 may be provided by an element on or of the quick connect roof jack 017, such as if the quick connect roof jack 017 were to comprise a projection corresponding to the opening 009. As shown, the quick connect attachment head 016 comprises a projection 018 corresponding to the opening 009.

As shown, the quick connect attachment head 016 further comprises at least one connector 019, connecting the quick connect attachment head 016 to the quick connect roof jack 017. The connectors 019 may be threaded and comprise nuts 020. In alternative embodiments, a range of connectors (with or without threads, nuts, cotter pins, other fasteners) may be utilized. Not shown, a washer or other spacer may be interposed between the bottom of the quick connect attachment head 016 and the quick connect roof jack 017. The washer or other spacer may be a tube, square, rectangle, etc., and may be connected or affixed to the quick connect roof jack 017 and/or the quick connect attachment head 016. As shown, the quick connect attachment head 016 further comprises an optional eye 021 suitable for a lanyard attachment (see FIG. 8)

FIG. 7 is a perspective view from below of a quick connect roof clip 004, a quick connect attachment head 016, and a quick connect roof jack 017. This perspective view shows the projection 018 engaged with the opening 009. This perspective shows that the projection 018 comprises a wider portion 022, sized to fit through the wider portion of the opening 010 but not through the narrower portion of the opening 011. Thus, when gravity pulls down and back (away from the quick connect attachment head 016) on the quick connect roof jack 017, the projection 018 and opening 009 together form a gravity-locking connector which prevents the quick connect roof jack 017 from disengaging from the quick connect roof clip 004, unless a force, such as may be provided by a person, counter-acts the gravitational force. All such cases may be referred to in the claims as "a connector" and shall be understood to be equivalent to "a connector."

FIG. 8 is a perspective view of a quick connect roof clip 004, a lanyard attachment 023, a quick connect attachment head 016, and a quick connect roof jack 017. This perspective shows that the opening 009 may be large enough to simultaneously accommodate the projection 018 and the lanyard attachment 023. Not shown, the opening 009 may be large enough to simultaneously accommodate the projection 018, the lanyard attachment 023, and to allow the quick connect roof jack 017 and projection 018 to be lifted up and disengaged from the opening 009 without removal of the lanyard attachment 023. Alternatively, and as discussed in relation to FIG. 3, a second opening, such as 012, may be provided for attachment of the lanyard attachment 023. Alternatively, and as discussed in relation to FIG. 6, an optional eye 021 may be provided for attachment of the lanyard attachment 023. As shown, the optional eye 021 is part of or affixed to a connector 019; in alternative embodiments, the eye 021 may have a dedicated attachment to the quick connect attachment head 016 and/or the quick connect roof jack 017; in an alternative embodiment the quick connect attachment head 016 may have an opening for attachment of the lanyard attachment 023. In alternative embodiments, the quick connect roof jack 017 may include a different and/or additional opening or securement point for attachment of a lanyard attachment 023. The lanyard attachment 023 is shown for simplicities sake without the rope, webbing, cable, cord or similar which may attach the lanyard attachment 023 to a worker's safety harness, to another rope, webbing, cable, cord or similar. The lanyard attachment 023 may be another shape or structure than as shown, such as a locking or non-locking carabiner, rope, cord, webbing, cable or similar passed through the opening 009 and releasably secured. Lanyard attachments 023 are understood herein to be releasably attachable.

Figure 9:
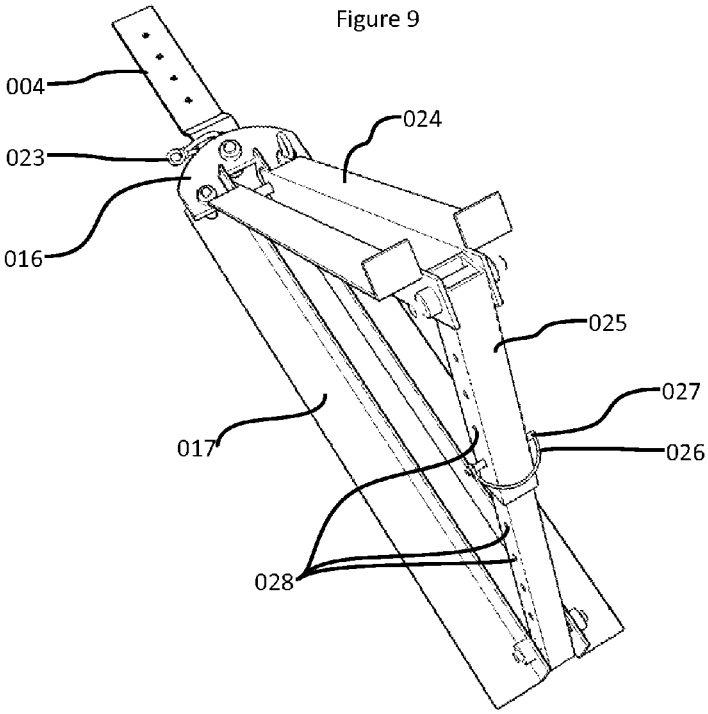
FIG. 9 is a perspective view from above of a quick connect roof jack.

FIG. 9 is a perspective view from above of a quick connect roof jack 017, a quick connect attachment head 016, a quick connect roof clip 004, and a lanyard attachment 023. The quick connect roof jack 017 is depicted as comprising a plank-receiving portion 024 which may be adjusted to have a generally horizontal angular relationship with the ground or other frame of reference; the plank-receiving portion's 024 angular relationship may be adjusted by changing the length of the adjustable-length portion 025. The length of the adjustable-length portion 025 may be changed by, for example, disengaging retaining clip 026 from one side of the pin 027, which may allow the pin 027 to be withdrawn from the aligned holes 028, the relative overlap of the components of the adjustable-length portion 025 to then be adjusted, and the pin 027 to be inserted into a new set of aligned holes 028. Another mechanism may be used to adjust the angular relationship of plank-receiving portion 024 to the ground or other frame of reference, such as an adjustable-length portion 025 with an outer and an inner portion and a clamp (such as a screw clamp) to clamp the two in a releasable relationship.

Figure 10:
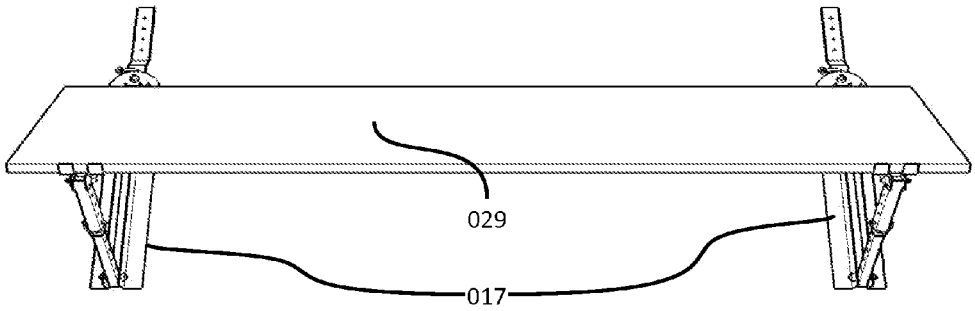
FIG. 10 is a perspective view from above of a set of quick connect roof jacks spanned by a plank.

FIG. 10 is a perspective view from above of a set of quick connect roof jacks 017 spanned by a plank 029. Not shown, a screw, bolt, bracket or similar may be utilized to secure the plank 029 to one or more of the quick connect roof jacks 017. The plank may be wood, metal, composites, a manufactured structure or a mixture thereof.

Figure 11:
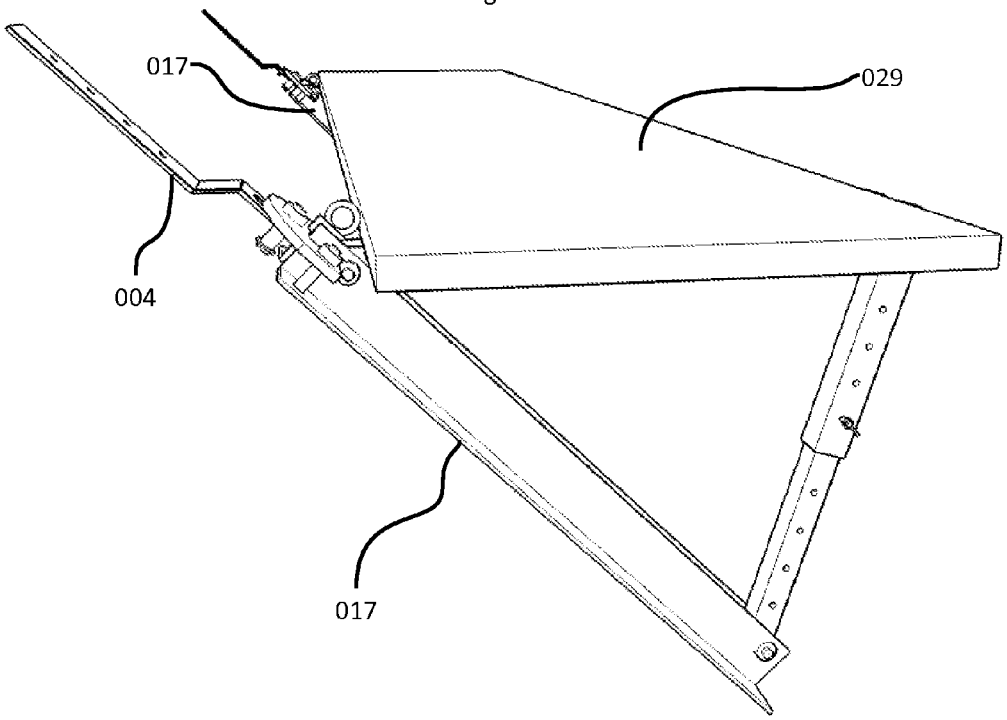
FIG. 11 is a perspective view from the side of a set of quick connect roof jacks spanned by a plank.

FIG. 11 is a perspective view from the side of a set of quick connect roof jacks 017 spanned by a plank 029. FIG. 11 is meant to depict the plank 029 as having a generally horizontal angular relationship with the ground. As in other of the figures, a shingle is not shown covering much of the first portion of the quick connect roof clip 004.

As shown in the figures and as discussed above, a quick connect roof clip 004 is releasably attachable to at least one quick connect roof jack 017. As noted, the quick connect roof clip 004 is releasable from the quick connect roof jack 017 and may be left in place for later use. A structure or element is provided for attachment of a lanyard attachment 023. The quick connect roof clip 004 and quick connect roof jack 017 may be releasably connected by a quick connect attachment head 016, though the projection or opening on the attachment head 016 corresponding to the opening or projection on the quick connect roof clip 004 may be part of or provided by a structure or element on or of the quick connect roof jack 017.

As used herein, "releasably attachable" and "releasably connectable" are understood to be equivalent; "attach" and "connect" (and "attachable" and "connectable") are also understood to be equivalent; and "releasable," "releasably," "releasably attachable," and/or "releasably connectable" are understood to mean being able to be repeatedly connected/disconnected (or engaged/disengaged) through the use of the hands, feet, or human appendage, with application of human-scale work effort, not generally requiring the use of a tool.

The components discussed in this specification may be made of or from a wide range of materials non-exclusively including aluminum, steel, iron, copper, tin and alloys between and including these and other materials, as well as and/or including composites such as fiber-glass, aramid, carbon-fiber, an other fibers combined with resin and/or epoxy.

The invention claimed is:

1. A roof jack system comprising:

a roof jack comprising:

a base, a plank-receiving portion connected to the base at a first end of the roof jack, and an adjustable-length portion connected to the plank-receiving portion and to a second end of the roof jack, an attachment head releasably attached to a clip affixable to a roof, which attachment head comprises:

a plate attached to the first end of the roof jack, wherein the plate is held above the base of the roof jack by a first attachment head-roof jack connector and wherein a bottom of the plate is held a sufficient distance above the base of the roof jack by the first attachment head-roof jack connector to accommodate the roof-affixable clip when both are on a roof, the first attachment head-roof jack connector connecting the attachment head and the roof jack, and a projection releasably attachable to the roof affixable clip;

the clip affixable to a roof comprising:

a first portion comprising one or more perforations, which perforation is not open to an edge of the roof affixable clip and which perforation is sized to receive a fastener to attach the roof affixable clip to a roof, a second portion comprising an opening sized to accommodate the projection, wherein the second portion is oriented on the same horizontal axis as the first portion and wherein a bottom surface of the second portion is above a top surface of the first portion, providing an open space below the bottom surface of the second portion, and a sloped portion connecting the first and second portions.

2. The roof jack system according to claim 1 wherein the projection comprises a vertically oriented cylindrical component of a first diameter and a wider portion with a diameter greater than the first diameter, which wider portion is sized to fit through at least part of the opening in the roof affixable clip.

3. The roof jack system according to claim 1 wherein the angular relationship of the plank receiving portion relative to the ground or another reference frame may be adjusted by changing the length of the adjustable-length portion.

4. The roof jack system according to claim 1, wherein the projection projects down from the bottom of the plate a distance equal to or less than the sufficient distance to accommodate the roof affixable clip.

5. The roof jack system according to claim 1, wherein the plate comprises the first attachment head-roof jack connector and a second attachment head-roof jack connector.

6. The roof jack system according to claim 5 wherein the first and second attachment head-roof jack connectors each comprise a threaded bolt, which threaded bolt projects through an opening in the plate to a nut on top of the plate.

7. The roof jack system according to claim 6 wherein the first and second attachment head-roof jack connectors further comprise a spacer through which the threaded bolts pass, below the level of the plate.

8. The roof jack system according to claim 5 wherein the plate further comprises a cut-out to accommodate the base of the roof jack.

9. The roof jack system according to claim 1, wherein the sloped portion is at a 45° angle relative to both the first and second portions.

* * * * *